US005996671A

United States Patent [19]

Anderson et al.

[11] Patent Number: 5,996,671

[45] Date of Patent: Dec. 7, 1999

[54] CONNECTION SYSTEM BETWEEN A CARRIER AND PANTOGRAPH IN THE CONTROL SYSTEM OF A WINDOW COVERING

[75] Inventors: Richard N. Anderson, Whitesville; Eugene W. Thompson, Maceo, both of Ky.

[73] Assignee: Hunter Douglas Inc., Upper Saddle River, N.J.

[21] Appl. No.: 09/150,558

[22] Filed: Sep. 10, 1998

Related U.S. Application Data

[60] Provisional application No. 60/058,850, Sep. 10, 1997.

[51] Int. Cl.[6] ..... E06B 9/38

[52] U.S. Cl. ..... 160/173 V; 160/178.1 V

[58] Field of Search ..... 160/173 V, 168.1 V, 160/172 V, 178.1 V, 176.1 V, 177 V, 900, 405

[56] References Cited

U.S. PATENT DOCUMENTS

| | | | |
|---|---|---|---|
| D. 231,326 | 4/1974 | Miki . | |
| D. 325,681 | 4/1992 | Gartenmaier . | |
| 2,621,723 | 12/1952 | Etten . | |
| 2,759,534 | 8/1956 | Harju . | |
| 2,854,071 | 9/1958 | Toti . | |
| 2,876,834 | 3/1959 | Walker . | |
| 3,334,682 | 8/1967 | Eldredge, Jr. . | |
| 3,486,549 | 12/1969 | Rosenquist . | |
| 3,996,988 | 12/1976 | de Wit . | |
| 4,214,622 | 7/1980 | Debs . | |
| 4,267,875 | 5/1981 | Koks . | |
| 4,316,493 | 2/1982 | Arena . | |
| 4,361,179 | 11/1982 | Benthin . | |
| 4,381,029 | 4/1983 | Ford et al. . | |
| 4,386,644 | 6/1983 | Debs . | |
| 4,425,955 | 1/1984 | Kaucic . | |
| 4,628,981 | 12/1986 | Ciriaci et al. | 160/176.1 V |
| 4,648,436 | 3/1987 | Oskam . | |
| 4,724,883 | 2/1988 | Liebowitz . | |
| 4,773,464 | 9/1988 | Kobayashi . | |
| 4,799,527 | 1/1989 | Villoch et al. | 160/168.1 V |
| 4,869,309 | 9/1989 | Evans . | |
| 5,012,850 | 5/1991 | Schrader . | |
| 5,088,542 | 2/1992 | Biba et al. . | |
| 5,249,617 | 10/1993 | Durig . | |
| 5,289,863 | 3/1994 | Schon . | |
| 5,445,205 | 8/1995 | Hansen | 160/168.1 V |
| 5,626,177 | 5/1997 | Colson | 160/168.1 V |

FOREIGN PATENT DOCUMENTS

| | | |
|---|---|---|
| 120425 | 10/1984 | European Pat. Off. . |
| 159812 | 10/1985 | European Pat. Off. . |
| 868961 | 5/1961 | United Kingdom . |
| 1159635 | 7/1969 | United Kingdom . |
| 1470533 | 4/1977 | United Kingdom . |

*Primary Examiner*—David M. Purol
*Attorney, Agent, or Firm*—Dorsey & Whitney LLP

[57] ABSTRACT

A connection system between a carrier and a link of a pantograph in a control system of a covering for an architectural opening. The control system is adapted to move a plurality of carriers across at least a portion of the architectural opening. The connection system comprises an upstanding pin on the carrier, the pin having a laterally projecting key, and an aperture in the link. The aperture has a main portion extending upwardly from a bottom surface of the link and an enlarged recess extending downwardly from a top surface of the link, thereby defining an annular shoulder around the top of the main portion. An intermediate keyway communicates between the main portion of the aperture and the enlarged recess. The keyway is adapted to receive the key on the carrier to facilitate interconnection of the carrier with the link and pivotal movement of the carrier relative to the link after interconnection.

9 Claims, 2 Drawing Sheets

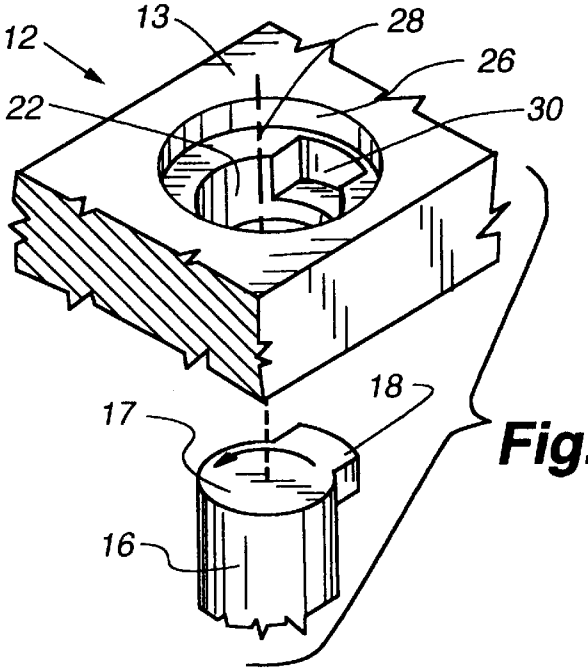
Fig. 5A
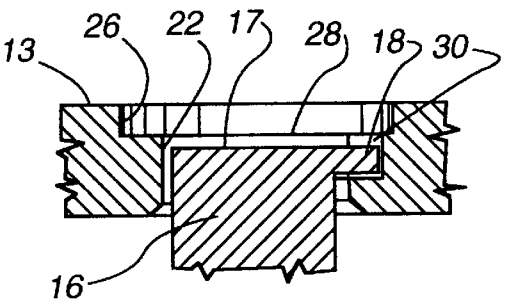
Fig. 5C
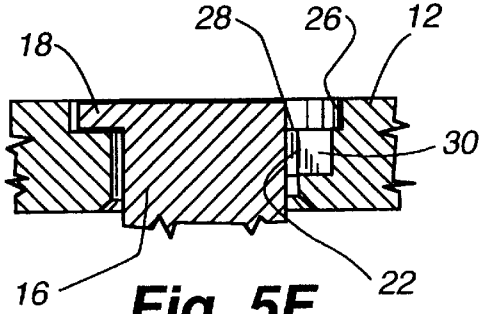
Fig. 5E
Fig. 5B
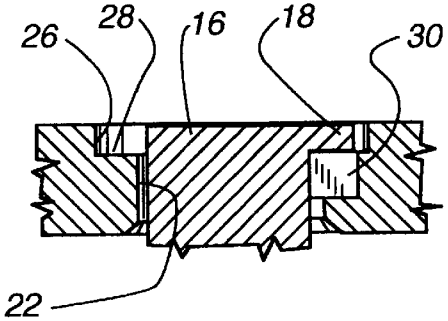
Fig. 5D
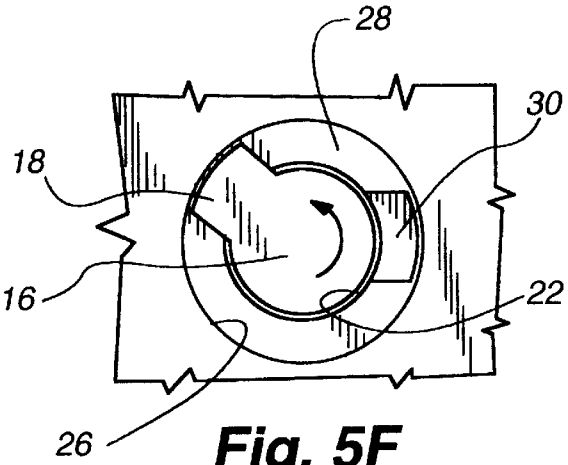
Fig. 5F

CONNECTION SYSTEM BETWEEN A CARRIER AND PANTOGRAPH IN THE CONTROL SYSTEM OF A WINDOW COVERING

CROSS REFERENCE TO RELATED APPLICATION

This application claims priority to U.S. provisional application Ser. No. 60/058,850, filed Sep. 10, 1997, which is hereby incorporated by reference as though fully set forth in the present application. This application is related to U.S. utility application Ser. No. 08/915,793, filed Aug. 21, 1997 and entitled "A Control System for a Vertical Vane Covering for Architectural Openings," which is hereby incorporated by reference as though fully set forth in the present application.

BACKGROUND OF THE INVENTION

1. Field of the Invention

The present invention relates generally to vertical vane coverings for architectural openings such as doors, windows, and the like, and to a control system for such a covering that includes a plurality of carriers connected to vertically suspended vanes linearly movable between extended and retracted positions as well as pivotally movable between open and closed positions, to control visibility and the passage of light through the architectural opening and more particularly to a system for connecting the carriers to a pantograph adapted to move the carriers and thus the vanes across the architectural opening.

2. Description of the Relevant Art

Coverings for architectural openings such as doors, windows, and the like have been known in various forms for many years. One form of such coverings is commonly referred to as a vertical vane covering wherein a control system suspends and is operable to selectively manipulate a plurality of vertically suspended vanes such that the vanes can be linearly moved laterally across the architectural opening to extend or retract the covering and can be pivoted about longitudinal vertical axes to open and close the vanes.

Control systems for operating vertical vane coverings typically include a headrail in which a plurality of carriers associated with the vanes are mounted for lateral movement, and include internal mechanisms for pivoting the vanes about their vertical axes. The headrails vary in construction and configuration to house the various types of carriers and internal mechanisms. Most such headrails, however, have a slot along a bottom wall through which a portion of each carrier protrudes for connection to an associated vane.

Carriers in vertical vane coverings may be interconnected by a pantograph so that movement of an endmost or lead carrier causes all of the remaining carriers to move correspondingly. One problem with prior art control systems has been the simplification and dependability of the manner in which the carriers are connected to the pantograph.

Most control systems include pull cords that are operably connected to the carriers to shift or linearly move the carriers horizontally within the headrail and across the architectural opening. Control systems also usually include a horizontally disposed tilt rod operably connected to each carrier such that rotational movement of the tilt rod about its longitudinal axis transfers corresponding movement to the carriers and subsequently to the vanes to effect pivotal movement of the vanes about their longitudinal vertical axes. The tilt rod is typically rotated by a pull cord or a tilt wand that can be grasped by an operator of the system.

A common problem and critical issue with most control systems for coverings for architectural openings is the ease of assembly of the system, particularly since most systems have numerous and small operative components. The connection of the carriers to the pantograph is one area where ease of assembly is of importance and it is to this end that the present invention has been made.

SUMMARY OF THE INVENTION

The system of the present invention for connecting a carrier to a pantograph finds a beneficial use in control systems for coverings for architectural openings wherein the covering includes a plurality of vertically suspended vanes adapted to be uniformly disposed across the architectural opening or selectively retracted to a side of the opening. The control system is also adapted to selectively pivot the vanes about longitudinal vertical axes of the vanes so as to move the vanes between an open position wherein they extend perpendicularly to the architectural opening and in parallel relationship with each other, and a closed position wherein they lie parallel with the architectural opening and in substantially coplanar or slightly overlapping relationship with each other.

The system for connecting a carrier to the pantograph has been uniquely designed for ease of assembly of the two component parts and so that once assembled, the carrier is freely and easily pivotable relative to the pantograph to which it is connected.

The connection system of the present invention finds a particular usefulness in a control system of the type disclosed in detail in our copending utility application Ser. No. 08/915,793, filed Aug. 21, 1997. In the system disclosed in the '793 application, the carrier has an upstanding pin with a key in the form of a laterally extending lip or projection that is adapted to be extended through a keyway in an aperture through a female link in the pantograph so that the key is supported by a surface of the female link when the carrier is connected to that link. In the present application, the key on the pin is substantially similar to that disclosed in the aforenoted application (see, e.g., the embodiment of FIGS. 26 and 27 of the '793 application), including a recessed shoulder in the aperture in the link of the pantograph on which the key is adapted to be slidably supported. In the present invention, however, the keyway in the aperture does not pass completely through the aperture. Rather, the keyway commences at an intermediate location to facilitate assembly or interconnection of the carrier and pantograph link, while making it harder for the upstanding pin to unintentionally disengage from the aperture in the link of the pantograph via the keyway, particularly when the pin comes under a load during operation of the covering. The closed off bottom portion of the keyway in the female link of the present invention acts as a bearing surface near the base of the pin, thereby inhibiting undesirable deflection of the pin.

Other aspects, features, and details of the present invention can be more completely understood by reference to the following detailed description of a preferred embodiment, taken in conjunction with the drawings, and from the appended claims.

BRIEF DESCRIPTION OF THE DRAWINGS

FIG. 5A is a fragmentary isometric of a portion of the female link of FIG. 2 and of the pin on the carrier of FIG. 1 with the two components aligned for connection;

FIGS. 5B–5E are operational sections illustrating the method of connecting a pin on a carrier to a female link in a pantograph; and FIG. 5F is a fragmentary top plan view of the female link of FIG. 2 with the pin of the carrier of FIG. 1 shown connected thereto.

DESCRIPTION OF THE PREFERRED EMBODIMENT

Figure 1:
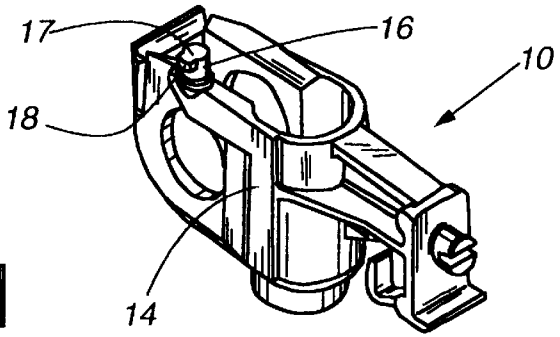
FIG. 1 is an isometric view looking down on the top of a typical carrier for use in a control system for a covering for an architectural opening.

The system for connecting a carrier 10 to a female link 12 in a pantograph of the present invention is a modification or an alternative embodiment to the system disclosed in our copending '793 utility application. The '793 application describes in detail alternative embodiments of a carrier for connecting suspended vanes of a covering for an architectural opening to a pantograph forming part of the control system for the covering. The pantograph (FIGS. 4, 5, and 34, for example, of the '793 application show a pantograph operably connected to a plurality of carriers) is adapted to move the carriers and the vanes along the length of a tilt rod as disclosed in detail in the '793 application. The carrier will not be described again in detail herein, but for purposes of the present disclosure the carrier 10 is identical to that disclosed in the aforenoted application (see, e.g., FIGS. 26 and 27 of the '793 application). The carrier 10 has a main body 14 and an upstanding protrusion or pivot pin 16 for pivotally connecting the carrier 10 to the pantograph. The pin 16 has at its upper end a top surface 17 and a laterally extending rectangular tab or key 18 in the form of a projection or lip of substantially rectangular cross-section.

As will be appreciated from the '793 application, the pantograph used in the control system includes male and female links, and the female link disclosed in the '793 application has been modified as disclosed hereafter for connection with the carrier 10 in a manner different from that described in the '793 application.

Figure 4:
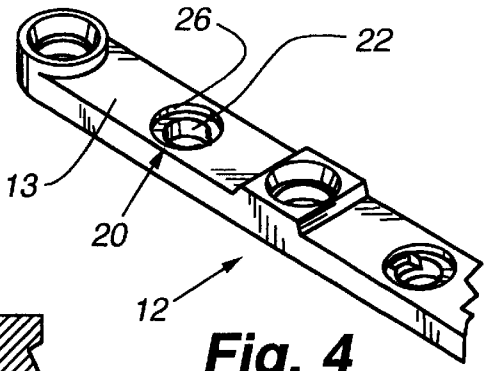
FIG. 4 is a fragmentary isometric looking down on the top of the link of FIG. 2.
Figure 2:
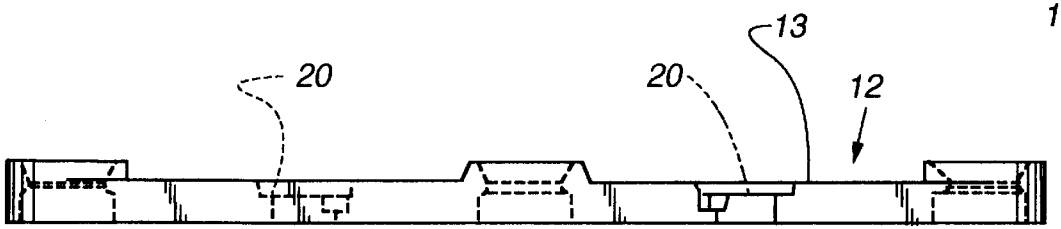
FIG. 2 is a side elevation of a female link used in a pantograph of a control system for a covering for an architectural opening.
Figure 3:
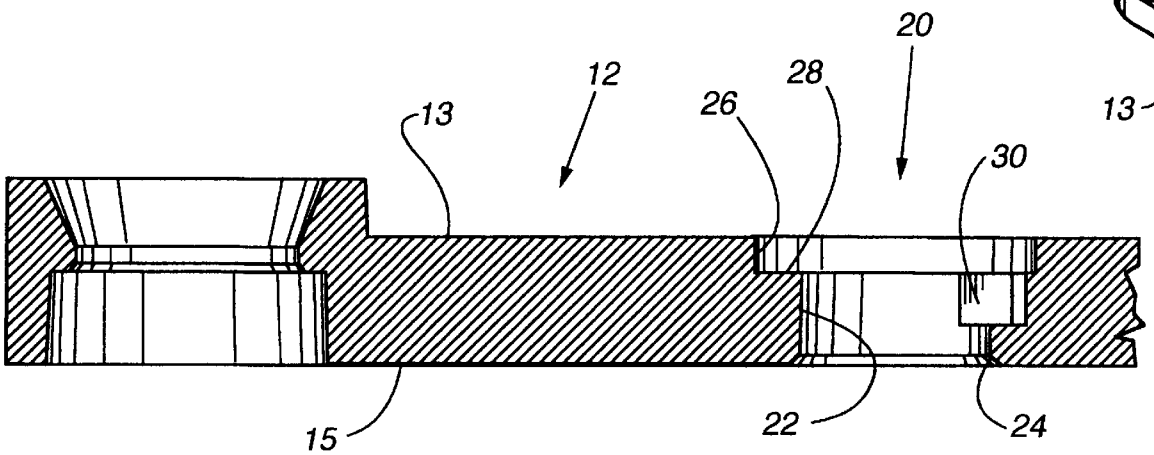
FIG. 3 is an enlarged fragmentary longitudinal section taken through the female link of FIG. 2 illustrating the aperture through which the carrier of FIG. 1 is adapted to be pivotally connected to the female link of FIG. 2.

As will be appreciated by reference to FIGS. 2 through 4, the female link 12 of the present invention, which has a top surface 13 and a bottom surface 15, is identical to that disclosed in the '793 application except with regard to the two intermediate holes or apertures 20, which are positioned about a quarter of the length of each female link 12 from the ends and are adapted for connecting the female link 12 to a carrier 10. In the present invention, and as best seen in FIG. 3, the aperture 20 in the female link 12 to which the carrier 10 is releasably connected has a lower main cylindrical portion 22 with a chamfered lower edge 24 and a relatively large diameter upper recess 26, adjacent the top surface 13 and defining a circumferential shoulder 28 for a purpose to be described hereafter. The diameter of the lower main cylindrical portion 22 is slightly greater than the diameter of the pin 16 on the carrier 10. At a location in the circumference of the aperture 20 that is closest to the longitudinal center of the female link 12, a keyway 30 of substantially rectangular cross-section is formed at an intermediate elevation between the top surface 13 and the bottom surface 15 of the female link 12 with the keyway 30 communicating with both the lower main cylindrical portion 22 of the aperture 20 and the enlarged upper recess 26. The keyway 30 is of a size slightly greater than the size of the key 18 on the upstanding pin 16 of the carrier 10 with the depth of the keyway 30 being approximately twice the thickness of the key 18 in the preferred embodiment.

The diameter of the pin 16 at its uppermost extent, including the length of the key 18 is slightly greater than the diameter of the main cylindrical portion 22 of the aperture 20 so that the upstanding pin 16 on the carrier 10 cannot be advanced axially through the main cylindrical portion 22 of the aperture 20. Rather, and as illustrated in FIGS. 5B through 5F, the carrier 10 can be inclined relative to the longitudinal axis of the female link 12 so that the key 18 on the upstanding pin 16 is angled toward the keyway 30 in the aperture as seen in FIG. 5B. Pivoting the carrier 10 slightly so that the top surface 17 of the upstanding pin 16 becomes parallel with the top surface 13 of the female link 12, FIG. 5C, allows the key 18 to protrude into the keyway 30 with the top of the carrier being parallel but spaced from the bottom surface 15 of the female link 12. In this position, the pin 16 can be axially advanced upwardly so that the key 18 on the pin 16 is disposed within the enlarged upper recess 26 (FIG. 5D). By slightly pivoting the carrier 10 about the axis of the pin 16, the key 18 will overlie the shoulder 28 (FIGS. 5E and 5F) in nonalignment with the keyway 30. The carrier 10 is then pivotably locked to the female link 12 throughout most of a full revolution of the carrier 10 relative to the female link 12. The keyway 30 and key 18 have been positioned on the female link 12 and the carrier 10, respectively, so that once the pantograph and carrier 10 are assembled and the vanes are suspended from the carriers 10, the movement of the female links 12 relative to the suspended carriers 10 is such that the key 18 does not become aligned with the keyway 30, and the carrier 10 is thereby dependably and pivotably connected to the female link of the pantograph through full operation of the covering.

Of course, to remove a carrier 10 from the pantograph, the tilt rod which extends through the carriers would have to be removed so that the carrier 10 could be positioned relative to the female link to align the key 18 on the pin 16 with the keyway 30. Thereafter, the carrier 10 could be disconnected from the pantograph by reversing the assembly procedure previously described.

All directional references (e.g., up, upper, uppermost, upwardly, down, downwardly, bottom, and top) used above are to aid the reader's understanding of the present invention, but should not create limitations, particularly as to the orientation of the apparatus.

Although the present invention has been described with a certain degree of particularity, it is understood that the present disclosure has been made by way of example, and changes in detail or structure may be made without departing from the spirit of the invention as defined in the appended claims.

We claim:

1. A connection system between a carrier and a link of a pantograph in a control system of a covering for an architectural opening, the control system adapted to move a plurality of carriers across at least a portion of the architectural opening, the connection system comprising in combination an upstanding pin on the carrier, said pin having a laterally projecting key;

an aperture in the link, said aperture having a main portion extending upwardly from a bottom surface of the link and an enlarged recess extending downwardly from a top surface of the link; thereby defining an annular shoulder above said main portion; and an intermediate keyway communicating between said main portion of said aperture and said enlarged recess, wherein said keyway does not extend completely through said main portion of said aperture, with said keyway adapted to receive said key on the carrier to facilitate interconnection of the carrier with the link and pivotal movement of the carrier relative to the link after interconnection.

2. The connection system of claim 1, wherein said upstanding pin has a top surface, and further wherein said laterally projecting key is adjacent said top surface of said upstanding pin.

3. The connection system of claim 1, wherein said enlarged recess has a circular cross section and further wherein said main portion has a circular cross section.

4. The connection system of claim 1, wherein said key has a thickness and wherein said keyway has a depth, and further wherein said depth of said keyway is approximately twice the thickness of said key.

5. The connection system of claim 3 wherein said main portion is immediately adjacent said enlarged recess, and wherein said annular shoulder is substantially flat and parallel to said top surface and said bottom surface of said link.

6. The connection system of claim 5, wherein said key has a thickness, and further wherein a perpendicular distance between said annular shoulder and said top surface of said link substantially corresponds to said thickness of said key.

7. The connection system of claim 5, wherein said main portion has a chamfered lower edge adjacent said bottom surface of said link.

8. A method of connecting a carrier and a link of a pantograph in a control system of a covering for an architectural opening, the control system adapted to move a plurality of carriers across at least a portion of the architectural opening, wherein the carrier comprises an upstanding pin having a laterally projecting key, and the link comprises an aperture having a main portion extending upwardly from a bottom surface of the link and an upper recess extending downwardly from a top surface of the link thereby defining an annular shoulder above said main portion, and further wherein an intermediate keyway communicates between said main portion of said aperture and said upper recess, wherein said keyway does not extend completely through said main portion of said aperture, with said keyway adapted to receive said key on the carrier to facilitate pivotable interconnection of the carrier with the link, the method comprising the steps of tipping said carrier to facilitate insertion of said projecting key of said upstanding pin into said keyway;

inserting said upstanding pin and said projecting key into said keyway;

aligning said upstanding pin with said main portion;

pushing said upstanding pin further into said main portion until said projecting key reaches a position adjacent and above said annular shoulder; and rotating said carrier and thus said upstanding pin to position said projecting key over said annular shoulder.

9. A method of connecting a carrier and a female link of a pantograph in a control system of a covering for an architectural opening, the control system adapted to move a plurality of carriers across at least a portion of the architectural opening, wherein the carrier comprises an upstanding pin having a top surface with a key projecting laterally therefrom, and the female link comprises a bottom surface, a top surface, a longitudinal axis, and an aperture, the aperture having a main cylindrical portion extending upwardly from the bottom surface of the female link and an enlarged upper cylindrical recess extending downwardly from the top surface of the female link thereby defining an annular shoulder around a top of the main cylindrical portion, and further wherein a keyway commencing from an intermediate position along the main cylindrical portion communicates between the main cylindrical portion and the upper cylindrical recess, wherein the keyway is adapted to receive the key to facilitate pivotable interconnection of the carrier with the female link, the method comprising the steps of inclining the carrier and thus the upstanding pin relative to the longitudinal axis of the female link, thereby angling the key toward the keyway;

inserting the key into said keyway;

pivoting the carrier until the top surface of the upstanding pin is substantially parallel to the top surface of the female link, and the key protrudes fully into the keyway;

axially advancing the upstanding pin until the key is disposed within the upper recess; and rotating the carrier and thus the upstanding pin to position the key over the annular shoulder.

* * * * *